US009151051B2

(12) United States Patent
Cossette et al.

(10) Patent No.: US 9,151,051 B2
(45) Date of Patent: Oct. 6, 2015

(54) 65 DB SOUND BARRIER INSULATED BLOCK

(71) Applicants: Andre Cossette, Quebec (CA); Lyhieryl P. Demegillo, Quebec (CA)

(72) Inventors: Andre Cossette, Quebec (CA); Lyhieryl P. Demegillo, Quebec (CA)

( * ) Notice: Subject to any disclaimer, the term of this patent is extended or adjusted under 35 U.S.C. 154(b) by 43 days.

(21) Appl. No.: 13/758,373

(22) Filed: Feb. 4, 2013

(65) Prior Publication Data

US 2014/0215949 A1 Aug. 7, 2014

(51) Int. Cl.

| | |
|---|---|
| ***E04C 1/41*** | (2006.01) |
| ***E04C 1/00*** | (2006.01) |
| ***E04C 5/07*** | (2006.01) |
| ***E04B 2/54*** | (2006.01) |
| ***E04B 2/28*** | (2006.01) |
| ***E04B 2/30*** | (2006.01) |
| ***E04B 2/44*** | (2006.01) |
| ***E04B 2/48*** | (2006.01) |

(Continued)

(52) U.S. Cl.

CPC ... *E04C 1/41* (2013.01); *E04B 2/28* (2013.01); *E04B 2/30* (2013.01); *E04B 2/44* (2013.01); *E04B 2/48* (2013.01); *E04B 2/50* (2013.01); *E04C 5/073* (2013.01); *E04B 2002/025* (2013.01); *E04B 2002/0247* (2013.01); *E04B 2002/0258* (2013.01)

(58) Field of Classification Search

CPC ..... E04C 1/41; E04C 5/073; E04B 2/30; E04B 2/44; E04B 2/50; E04B 2/48; E04B 2/28; E04B 2002/0247; E04B 2002/0258; E04B 2002/025

USPC ..... 52/404.1, 405.1, 405.2, 405.3, 405.4, 52/407.1, 407.4, 404.4, 568, 582.1, 600, 52/604, 607

See application file for complete search history.

(56) References Cited

U.S. PATENT DOCUMENTS

| | | | | |
|---|---|---|---|---|
| 915,195 | A * | 3/1909 | Lemb | 52/564 |
| 994,027 | A * | 5/1911 | O'Beirne | 52/564 |
| 1,420,478 | A * | 6/1922 | Forbush | 52/426 |

(Continued)

FOREIGN PATENT DOCUMENTS

| | | | |
|---|---|---|---|
| CA | 2585790 | A1 * | 6/2006 |
| FR | 2544359 | A * | 10/1984 |

(Continued)

OTHER PUBLICATIONS

International Search Report PCT/CA2014/000075 dated Jun. 11, 2014.

(Continued)

*Primary Examiner* — Rodney Mintz

(74) *Attorney, Agent, or Firm* — Frommer Lawrence & Haug LLP

(57) ABSTRACT

An assembly of at least two parts of blocks made of light weight concrete, wood, or rock separated by a channel void or filled with an insulating substance. Channels provide a sound barrier and insulation. Attachment of the blocks can be made by means of angular steel pins fixing blocks two by two, by means of adhesive fiber glass wrapping the blocks, by means of adhesive construction glue, or by means of crossed tie resisting to shear forces. Central channels in the blocks are dug to pass a metal rod to strengthen the whole assembly of blocks; a central passage pierced in a top face of a central block wherein a metal rod is inserted and continues through an end groove of an upper and a lower block. Or, channels are dug all along the periphery of the block, and horizontal and a vertical rods are affixed against the channel.

15 Claims, 13 Drawing Sheets

(51) Int. Cl.
*E04B 2/50* (2006.01)
*E04B 2/02* (2006.01)

(56) References Cited

U.S. PATENT DOCUMENTS

| | | | | | |
|---|---|---|---|---|---|
| 2,703,487 | A | * | 3/1955 | Ossoinack | 52/592.3 |
| 3,318,062 | A | * | 5/1967 | Grants | 52/309.12 |
| 3,653,170 | A | * | 4/1972 | Sheckler | 52/375 |
| 3,791,090 | A | * | 2/1974 | Kniefel | 52/590.2 |
| 3,982,369 | A | * | 9/1976 | Keleske | 52/309.12 |
| 4,018,018 | A | * | 4/1977 | Kosuge | 52/127.4 |
| 4,190,995 | A | * | 3/1980 | Armistead | 52/309.9 |
| 4,312,164 | A | * | 1/1982 | Walt et al. | 52/405.1 |
| 4,433,520 | A | * | 2/1984 | Maschhoff | 52/275 |
| 4,439,967 | A | * | 4/1984 | Dielenberg | 52/309.12 |
| 4,498,266 | A | * | 2/1985 | Perreton | 52/405.4 |
| 4,574,550 | A | * | 3/1986 | Maschhoff | 52/405.3 |
| 4,706,429 | A | * | 11/1987 | Young | 52/309.12 |
| 4,833,856 | A | * | 5/1989 | Zwagerman | 52/592.1 |
| 4,854,097 | A | * | 8/1989 | Haener | 52/309.11 |
| 4,866,891 | A | * | 9/1989 | Young | 52/105 |
| 4,884,382 | A | | 12/1989 | Horobin | |
| 4,889,310 | A | * | 12/1989 | Boeshart | 249/41 |
| 5,065,561 | A | * | 11/1991 | Mason | 52/309.12 |
| 5,086,600 | A | * | 2/1992 | Holland et al. | 52/592.6 |
| 5,390,459 | A | | 2/1995 | Mensen | |
| 5,428,933 | A | * | 7/1995 | Philippe | 52/592.1 |
| 5,459,971 | A | * | 10/1995 | Sparkman | 52/426 |
| 5,566,518 | A | * | 10/1996 | Martin et al. | 52/426 |
| 5,657,594 | A | * | 8/1997 | Morita et al. | 52/249 |
| 5,657,600 | A | | 8/1997 | Mensen | |
| 5,658,483 | A | * | 8/1997 | Boeshart | 249/191 |
| 5,687,531 | A | * | 11/1997 | Nelson et al. | 110/338 |
| 5,704,180 | A | | 1/1998 | Boeck | |
| 5,709,060 | A | | 1/1998 | Vaughan et al. | |
| 5,782,050 | A | * | 7/1998 | Boeshart | 52/426 |
| 5,845,448 | A | * | 12/1998 | Potvin | 52/563 |
| 5,890,337 | A | * | 4/1999 | Boeshart | 52/426 |
| 5,896,714 | A | * | 4/1999 | Cymbala et al. | 52/426 |
| 5,983,585 | A | * | 11/1999 | Spakousky | 52/405.4 |
| 5,992,114 | A | | 11/1999 | Zelinsky et al. | |
| D435,212 | S | * | 12/2000 | Philippe | D8/354 |
| 6,176,059 | B1 | | 1/2001 | Cantarano et al. | |
| 6,226,951 | B1 | * | 5/2001 | Azar | 52/604 |
| 6,230,462 | B1 | * | 5/2001 | Beliveau | 52/426 |
| 6,253,519 | B1 | * | 7/2001 | Daniel | 52/591.1 |
| 6,301,851 | B1 | * | 10/2001 | Matsubara | 52/430 |
| 6,324,804 | B1 | * | 12/2001 | Hoogstraten | 52/426 |
| 6,352,237 | B1 | | 3/2002 | Severino | |
| 6,378,260 | B1 | * | 4/2002 | Williamson et al. | 52/426 |
| 6,401,419 | B1 | * | 6/2002 | Beliveau | 52/592.6 |
| 6,536,172 | B1 | | 3/2003 | Amend | |
| 6,668,503 | B2 | * | 12/2003 | Beliveau | 52/426 |
| 6,698,710 | B1 | | 3/2004 | VanderWerf | |
| 6,820,384 | B1 | | 11/2004 | Pfeiffer | |
| 6,821,058 | B1 | * | 11/2004 | Dawson | 405/284 |
| 6,886,303 | B2 | | 5/2005 | Schmidt | |
| 6,931,806 | B2 | | 8/2005 | Olsen | |
| 6,978,581 | B1 | * | 12/2005 | Spakousky | 52/405.4 |
| 7,007,436 | B1 | * | 3/2006 | Kelley | 52/605 |
| 7,082,732 | B2 | * | 8/2006 | Titishov | 52/426 |
| 7,665,710 | B2 | * | 2/2010 | Cooper | 249/16 |
| 7,739,846 | B2 | * | 6/2010 | Garrett | 52/426 |
| RE41,994 | E | * | 12/2010 | Mensen | 52/426 |
| 8,555,588 | B2 | * | 10/2013 | Stokes | 52/383 |
| 8,733,051 | B2 | * | 5/2014 | Griffith | 52/396.09 |
| 2001/0029717 | A1 | * | 10/2001 | Spakousky | 52/405.4 |
| 2002/0092253 | A1 | * | 7/2002 | Beliveau | 52/426 |
| 2003/0213198 | A1 | * | 11/2003 | Bentley | 52/415 |
| 2005/0005556 | A1 | * | 1/2005 | Collier et al. | 52/578 |
| 2005/0120659 | A1 | | 6/2005 | Nickerson | |
| 2006/0117690 | A1 | * | 6/2006 | Garrett | 52/309.11 |
| 2007/0199273 | A1 | * | 8/2007 | Wang | 52/604 |
| 2010/0284751 | A1 | * | 11/2010 | Price | 405/284 |
| 2012/0090259 | A1 | * | 4/2012 | Muirhead et al. | 52/585.1 |

FOREIGN PATENT DOCUMENTS

| | | | | |
|---|---|---|---|---|
| FR | 2566817 | A1 | * | 1/1986 |
| KR | 2003024425 | A | * | 3/2003 |
| WO | WO 2014117260 | A1 | * | 8/2014 |
| WO | WO 2014117260 | A8 | * | 9/2014 |

OTHER PUBLICATIONS

CIPO Examination Notes dated Aug. 7, 2014.

* cited by examiner

65 DB SOUND BARRIER INSULATED BLOCK

FIELD OF THE INVENTION

The present invention generally relates to the field of construction, particularly of concrete blocks of light weight and insulating capacity as well as structural, sound barrier and resistance to earthquake.

DESCRIPTION OF THE PRIOR ART

Our research among patents revealed some systems that caught our attention:

FR2544359 discloses a concrete block having a pair of upstanding channels surrounded by a large void.

CA2585790 discloses a pair of slabs interlocked by panels; male-female connexions are installed on top and bottom.

OBJECTIVES AND ADVANTAGES

There is a need on the market of construction for a lightweight block, made of concrete, rock or wood material, assembled parallel, angularly, radial, T-shaped, shaft-shaped blocks of spaced apart components requiring a minimum of attachment. The blocks are insulated and use insulating substances, like mineral wool, fiber glass, air, or other substance with insulating properties, inserted in a space between each concrete block.

Description of Our Concept

Our concept includes the following elements, lightweight parallel concrete, wood or rock blocks provided with means of attachment, such as:

- folded pins directed on opposite angles and possibly connected two by two by thin metal crosses passing around pins which reinforce the ends during construction of walls. The rows are held by passing through metal rods which position any two blocks in a series to form a wall. Mortar or construction glue is used around the rods to strengthen them.
- Means of an adhesive fibreglass wrapping the blocks partially or completely to maintain them attached. Furthermore, the fibreglass is attached on a top face of blocks by means of inside small channels filled with epoxy glue or filled with a wire of nylon or metal enclosing the fibreglass within the channels.
- Means of attachment of blocks is to pour a strong glue on a surface of contact of blocks and to strongly stick them together.
- Another means of attachment are crossed ties attaching blocks two by two, pressed in notches dug on upper or lower surfaces of the blocks, and on their sides.

The blocks are insulated by inserting an insulating substance or by a void space between each parallel block.

The present invention will be further understood from the following description with reference to the drawings wherein like numbers refer to like parts for easy identification.

BRIEF DESCRIPTION OF THE EMBODIMENTS

DESCRIPTION OF THE PREFERRED EMBODIMENTS

Figure 1:
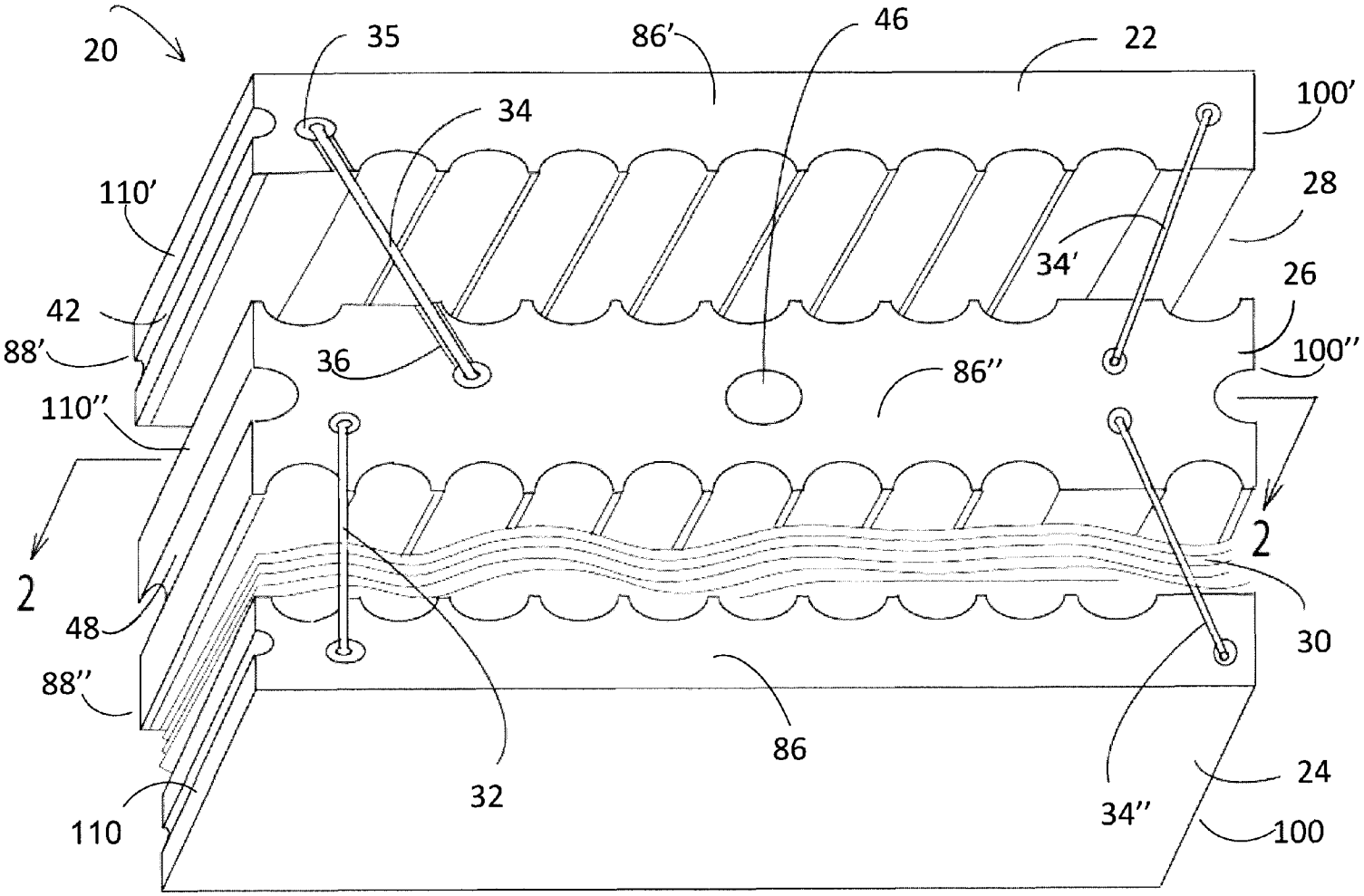
FIG. 1 is a perspective of a block with angular pins.

FIG. 1 shows an assembly 20 of three parts of parallelepiped blocks namely a front parallelepiped part 24, a parallelepiped center part 26 and a back parallelepiped part 22. Between the center part and the back part there appears to be a void channel 28 and between the center and the front part there appears to be a filled channel 30 which shows an insulating substance. The channels provide a sound barrier and insulation. The three parallelepiped parts have peripheral surfaces, namely top surfaces respectively identified 86, 86', 86"; below surfaces 88,88',88"; right hand end surfaces 100,100', 100" and left hand end surfaces 110,110'410".

A reverse U pin 32 is set perpendicularly between the top surface 86 of the front part 24 and the top surface 86" of the center part to maintain the two parts parallel. The pins shows alternate dispositions. Preferably the pins should be set angularly and in opposite directions and appear as angular pins 34, 34', 34". The reverse U pins are ties angularly positioned from 5° to 175° degrees from the vertical. A penetration hole 35 is pierced in the top surfaces of the blocks to receive legs of the pin to permit a length of penetration. The center part 26 is provided with a central passage 48 between an upper and a lower block to receive the passage of a strengthening metal rod originating from upper and lower blocks. At the top of the central part 26 there appears an enlarged radius 46 for depositing mortar around a metal rod originating from upper and lower blocks. One can see utility grooves 48. One can see an end groove 42.

Figure 2:
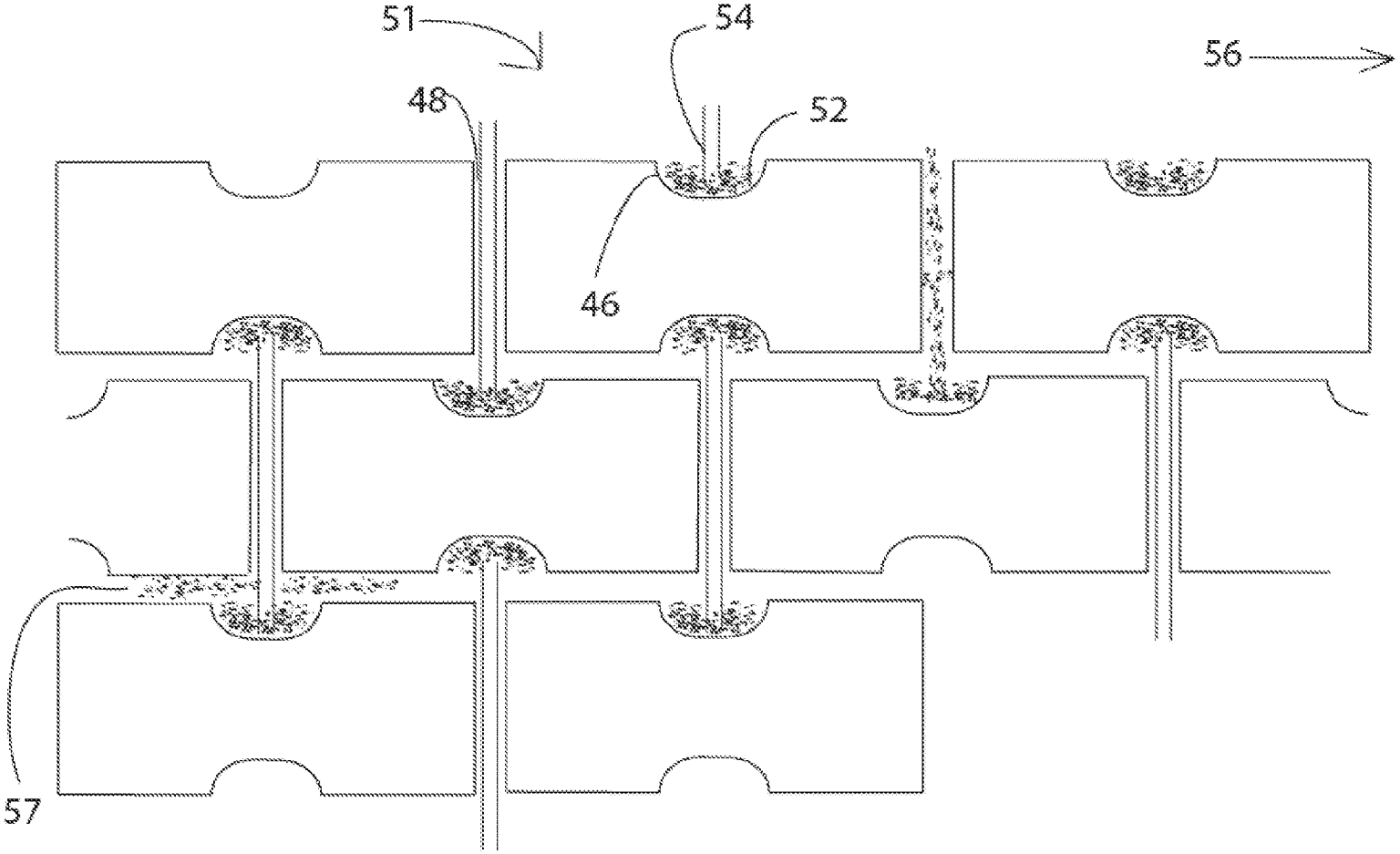
FIG. 2 is a cut view according to lines 2-2 of FIG. 1.

FIG. 2 shows a cut view of a row of blocks 51 with a central passage 48. An enlarged radius 46 is filled with mortar 52 or an adhesive and a metal rod 54 sticking out. A distance 56 between rods may be of the order of 4 feet (1200 mm). A mortar thickness 57 is between two horizontal rows of blocks. The same mortar continues vertically between blocks.

Figure 2A:
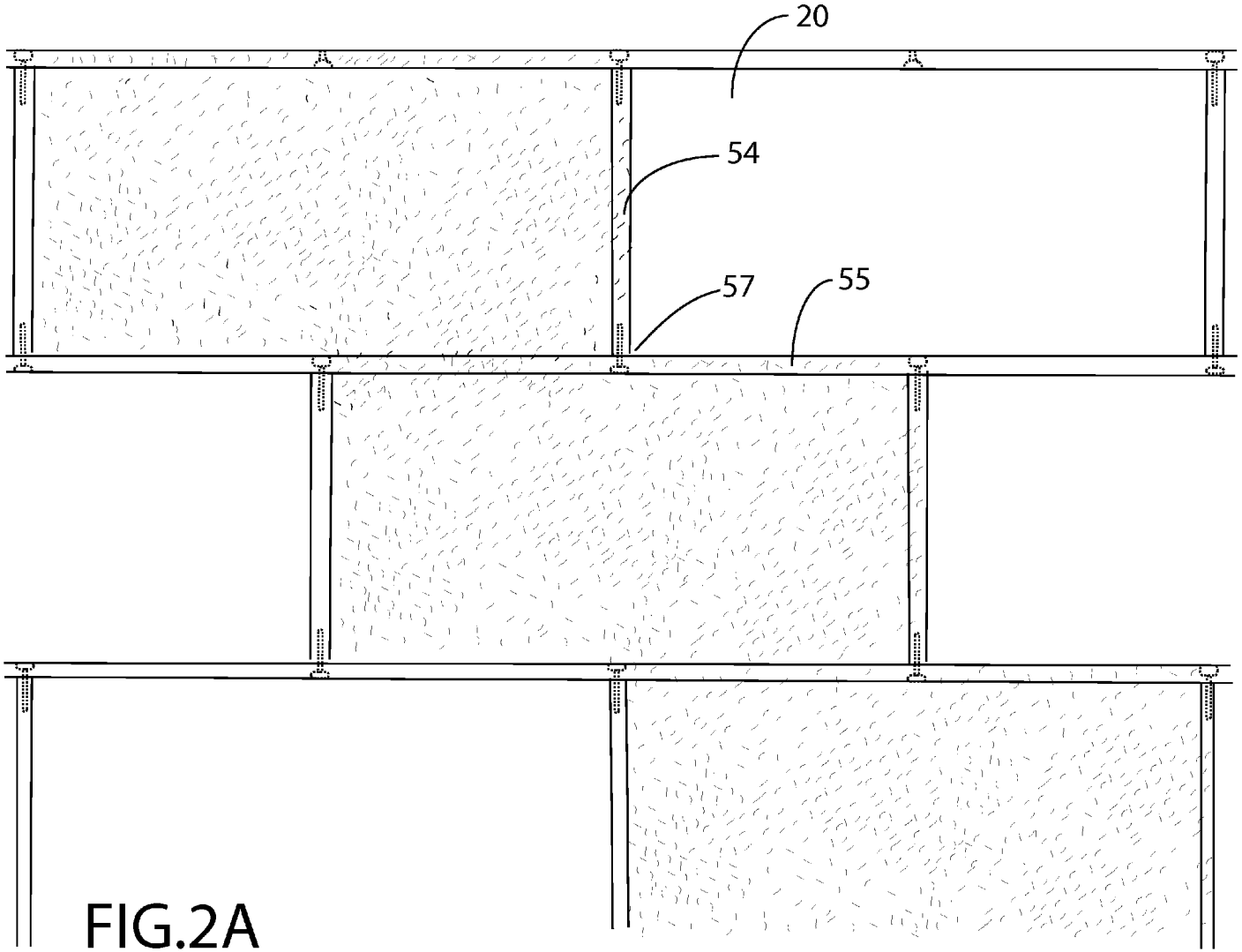
FIG. 2A is an assembly of blocks with reinforcing rods.

FIG. 2A shows a wall portion with blocks 20 separated by vertical metal rods

54 mounted over a horizontal rod 55 which extends over several units of blocks. At a junction 57 the vertical metal rod 54 is fastened to the continuing horizontal rod 55. Either rod may be of metal, plastic or fibreglass.

Figure 2B:
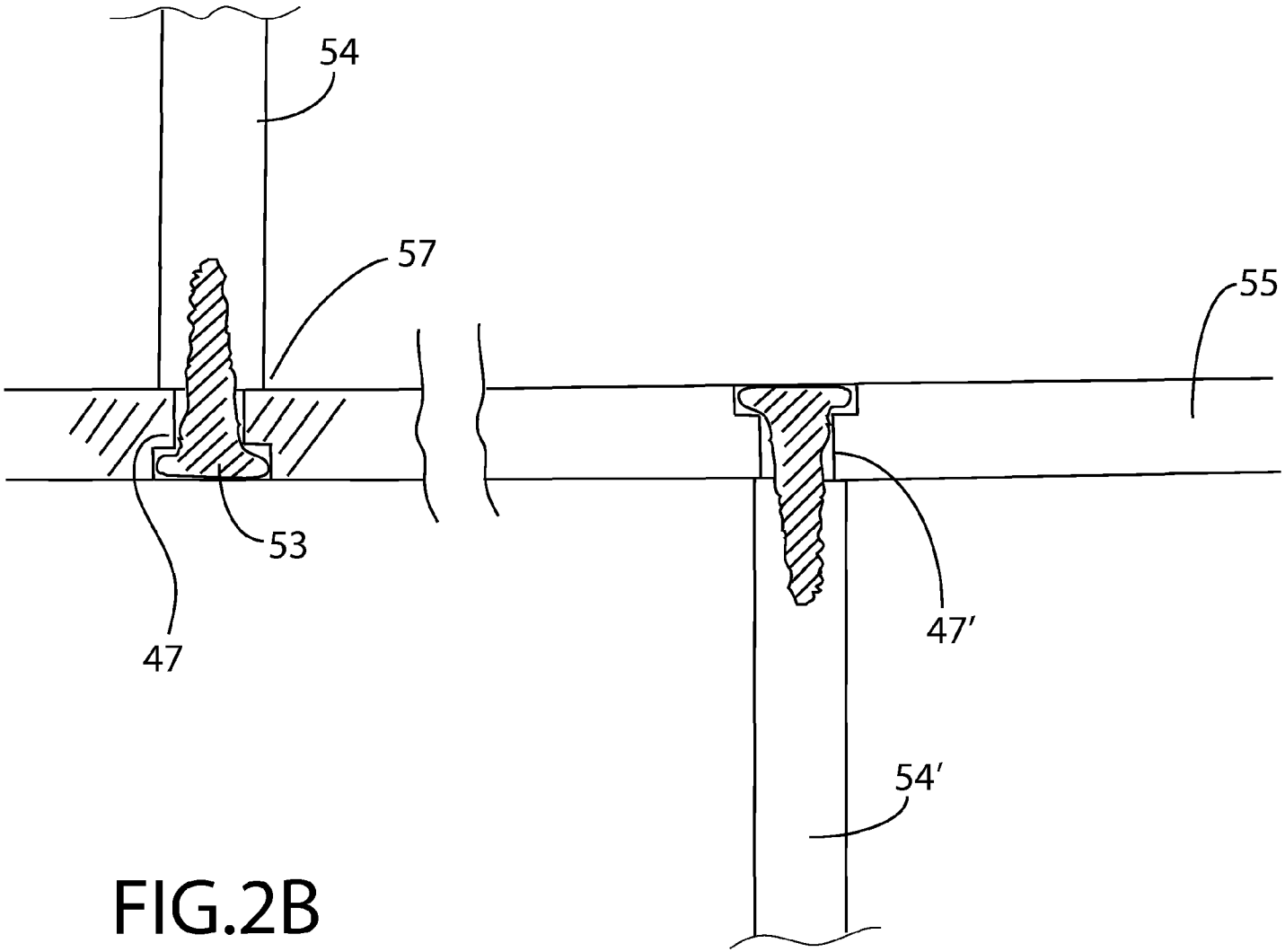
FIG. 2B is an enlarged view of a junction of rods.

FIG. 2B. shows a detailed view of the junction 57, namely the bottom of the vertical rod 54 pierced to receive a metal screw 53. The horizontal rod 55 shows a drilled passage 47, upwards or downwards according to use, to house the metal screw 53 including its head.

Figure 3:
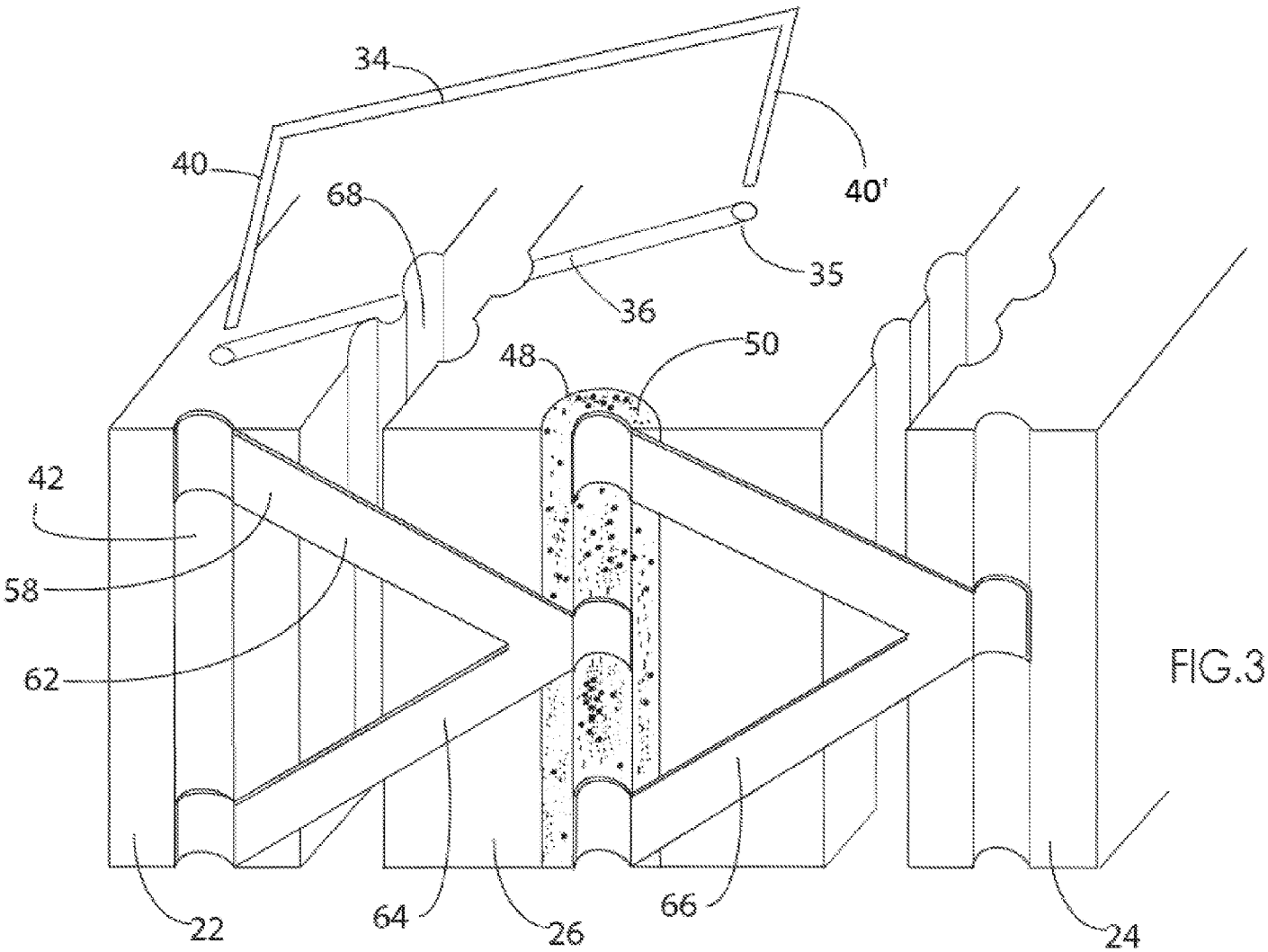
FIG. 3 is an end view of reinforced blocks.

FIG. 3 shows an angular pin 34 with a length of penetration 40 directed towards a penetration hole 35 and a horizontal position over a key slot 36 for eventual burying into the key slot. One sees a metal strip 58 positioned from an end groove 42 of the back part 22 towards the central passage 48 of the center part 26 with an angular direction 62 resulting in a strengthening yoke 64. A second metal strip 66 is added and positioned from the center part 26 towards the front part 24.

Figure 4:
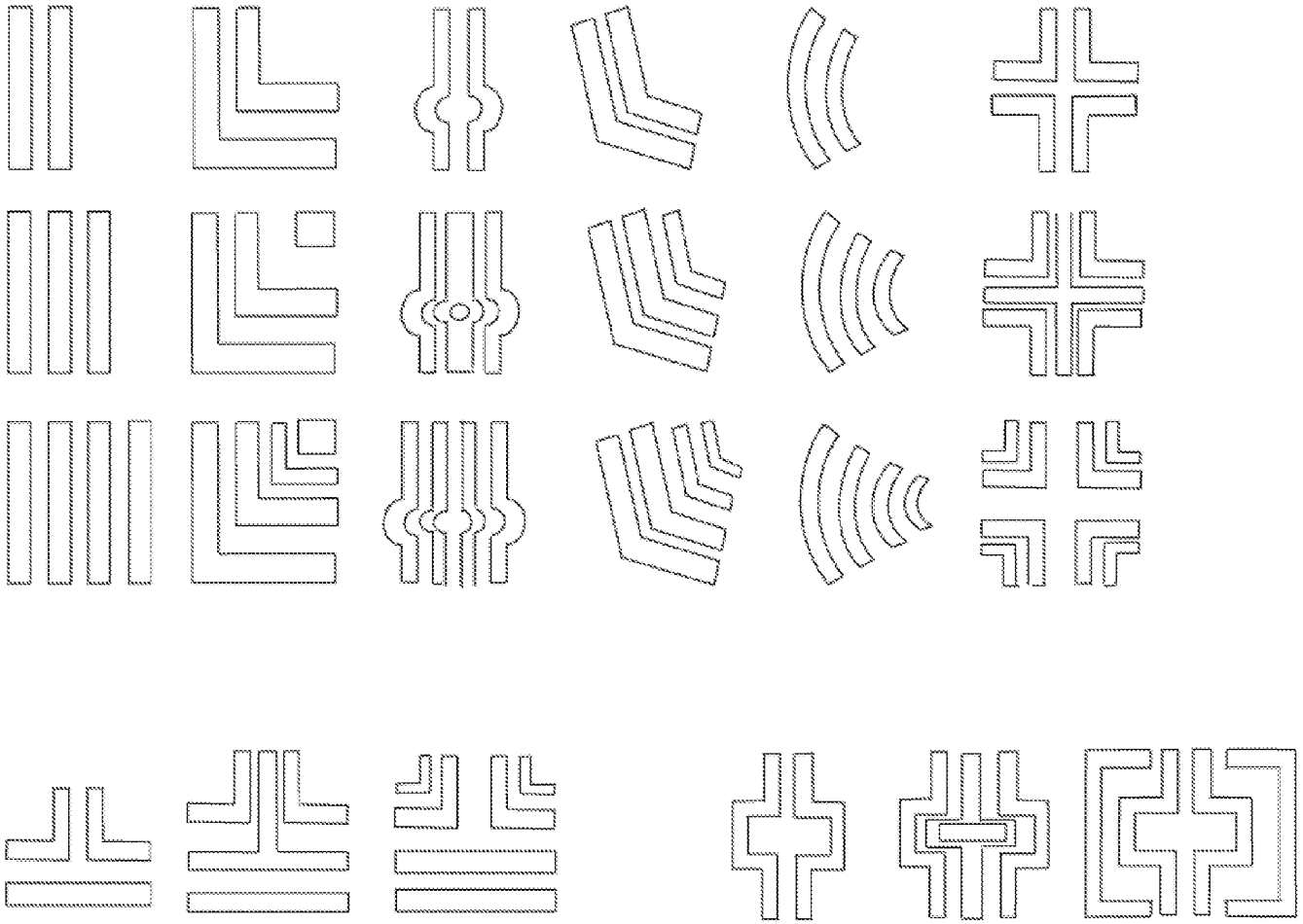
FIG. 4 is a top view of different forms of blocks.

FIG. 4 shows different forms of blocks.

Figure 5:
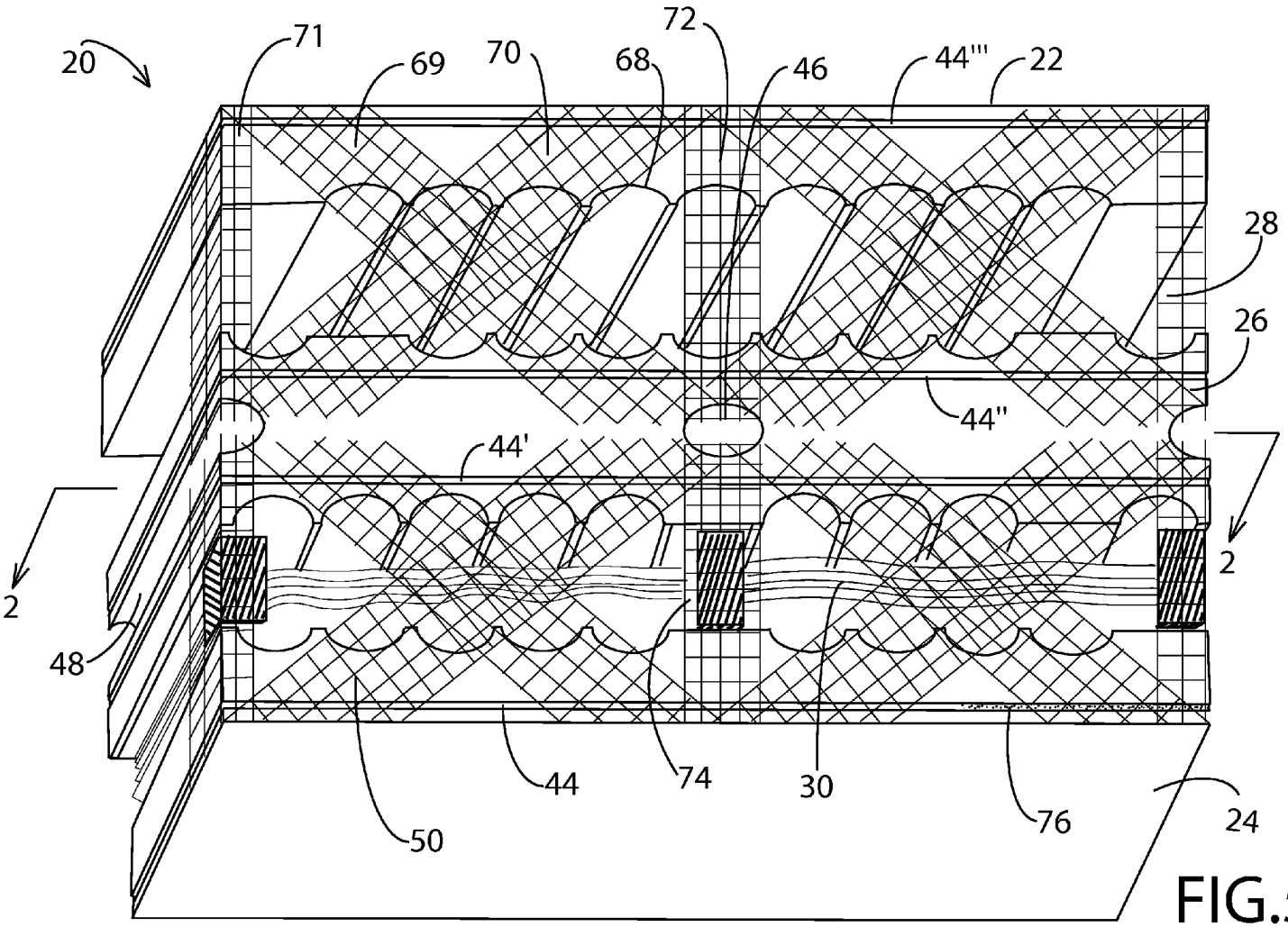
FIG. 5 is a perspective of a block with a wrapping net.

FIG. 5 shows the assembly of FIG. 1 without the pins nor the end grooves. Instead of the pins, each parallel block 24, 22, 26, is wrapped in cross or transversal tape with adhesive fibreglass. Half blanket fibreglass 50 in cross form is composed with a left oriented fibreglass tape 69 and a right oriented tape 70. A transverse fibreglass tape 72 maintains the back part 22 with the center part 26. End fibreglass tape 71 maintains the ends on the small side of the back part 22 with the end of the small side of the center part 26. Groove channels 44, 44', 44", 44'"filled with a wire 76 of metal, nylon or epoxy to fasten fibreglass on the surface of each block, upper, bottom and ends.

Figure 6:
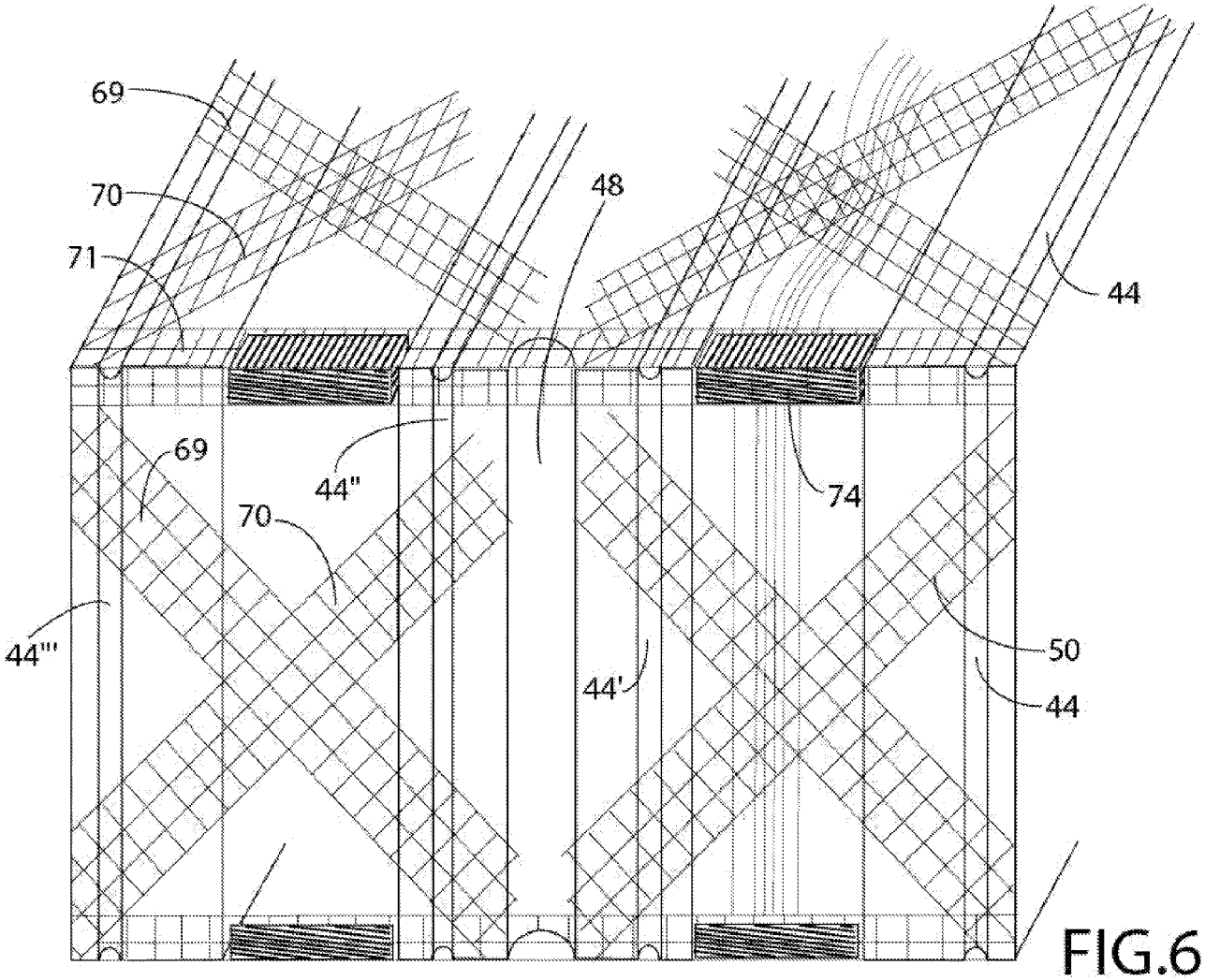
FIG. 6 is an end view of FIG. 5.

FIG. 6 shows a side view of FIG. 5 with an enlarged view of end fibreglass tape 71. Half blanket 50 with a left oriented fibreglass tape 69 and a right oriented tape 70. The groove channels 44, 44', 44", 44'" and the central passage 48 are shown. A rubber spacer 74 appears at an end. Its size is just short of the distance between two parallel plates.

Figure 7:
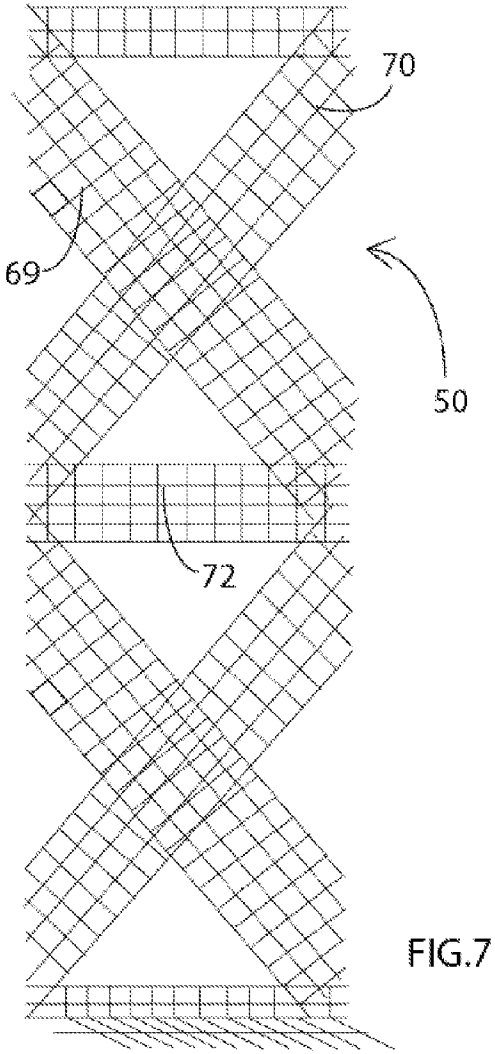
FIG. 7 is a top view of a fibreglass tape in a cross and transversal form.

FIG. 7 shows the transverse fibreglass tape 72 and the half blanket 50 formed with the left oriented fibreglass tape 69 and the right oriented tape 70.

Figure 8:
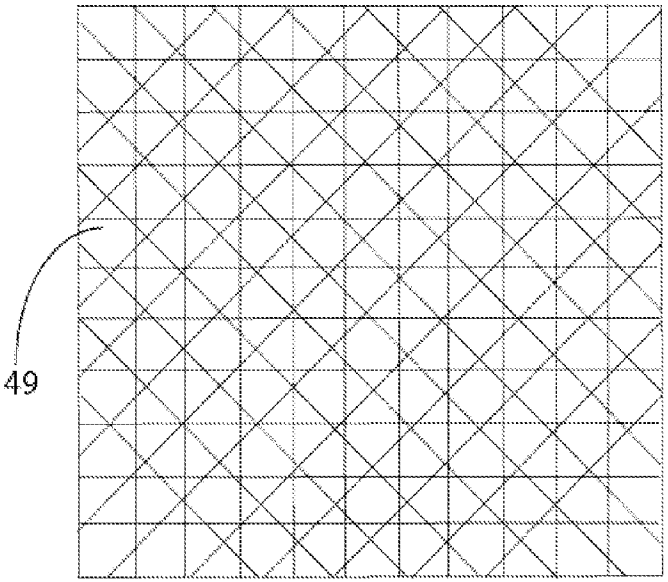
FIG. 8 is a top view of a fibreglass blanket.

FIG. 8 shows a fibreglass blanket 49. It comprises all three orientations as shown in FIG. 7

Figure 9:
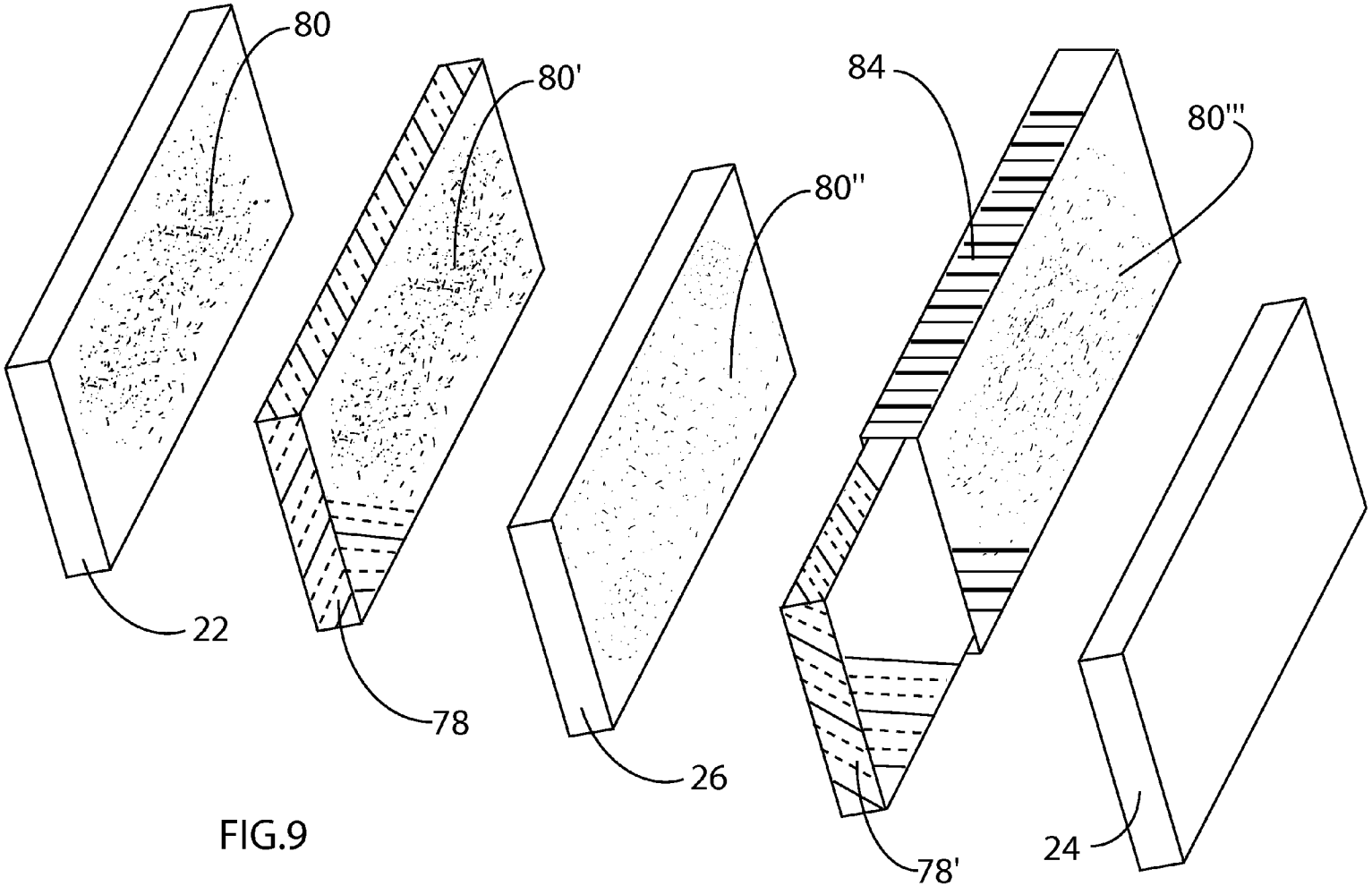
FIG. 9 is an exploded view of concrete parallels with filling.

FIG. 9 shows the front part 24, the center part 26 and the back part 22. Between the back part and the center part, a hot and cold insulation block 78 is inserted. Between the center part and the front part, a hot and cold insulation block 78' is covered by a plastic film 84 wrapped as a sleeve. Layers of adhesive 80, 80', 80", 80'" are used on surfaces of contact of each block of concrete and insulation and packing sleeve.

Figure 10:
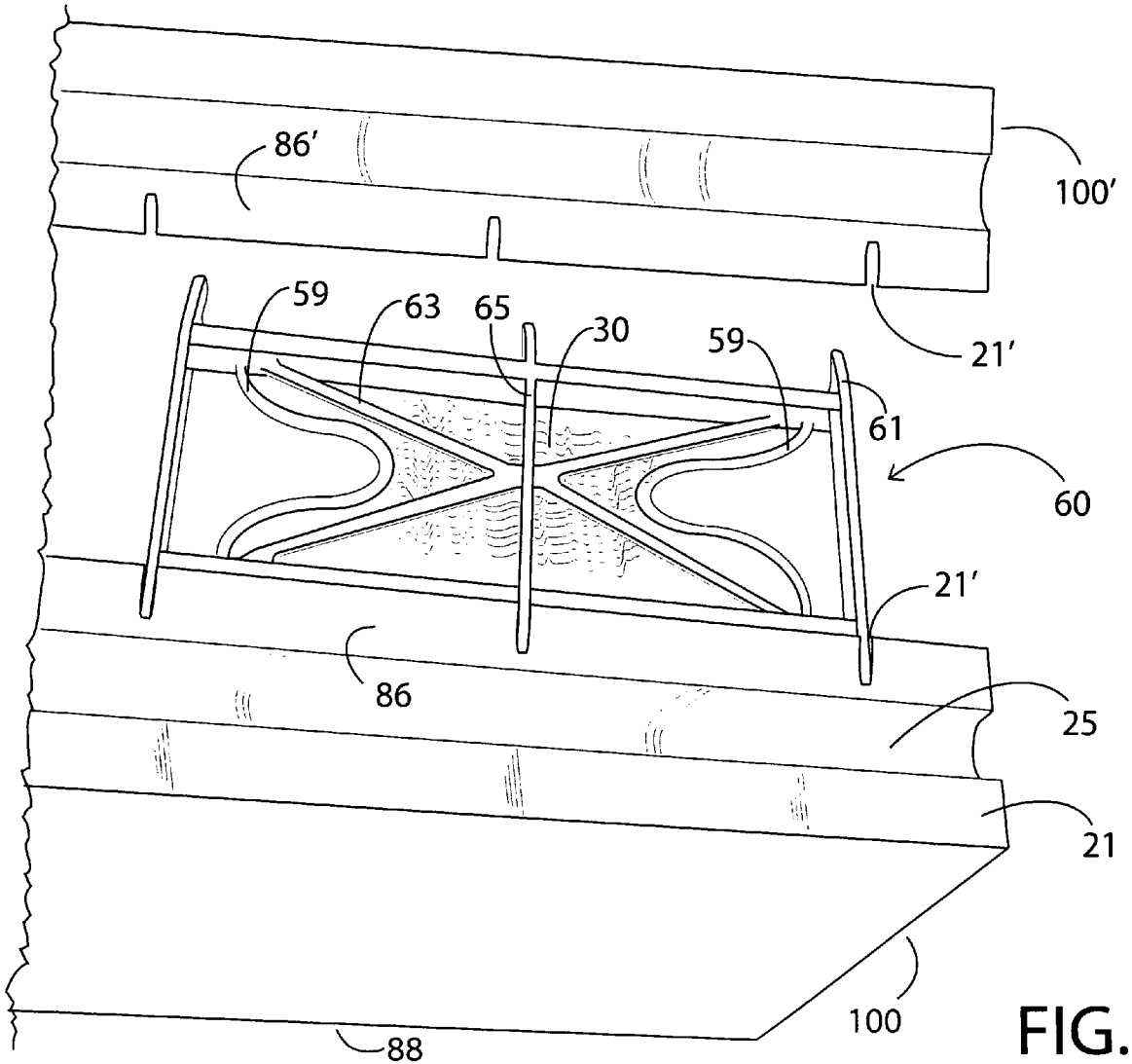
FIG. 10 is a top view of a crossed tie linking two notched blocks.

FIG. 10 shows a notched block 21 comprising notches 21' or dents made on the top surfaces 86,86", and wherein a crossed tie 60 is pressed. Another parallel block is intended to be fixed on the free tips of the crossed tie. The ties are used to maintain firmly together two blocks. The crossed tie 60 is in a shape of a rectangle wherein opposite corners are joined by straight webs thus forming a diagonal member 63 for avoiding shifting when the two blocks are subjected to oscillating during wind, storm, tornadoes, landslides or earthquake. A center member 65 is provided to maintain a parallel system. In between the free space of the two blocks an insulated material 30 is placed to provide a sound barrier. One can see a below surface 88 of the notched block, and the right hand end surfaces 100,100' of the two notched blocks destined to be covered by a like crossed tie 60 for covering two adjacent surfaces.

Figure 11A:
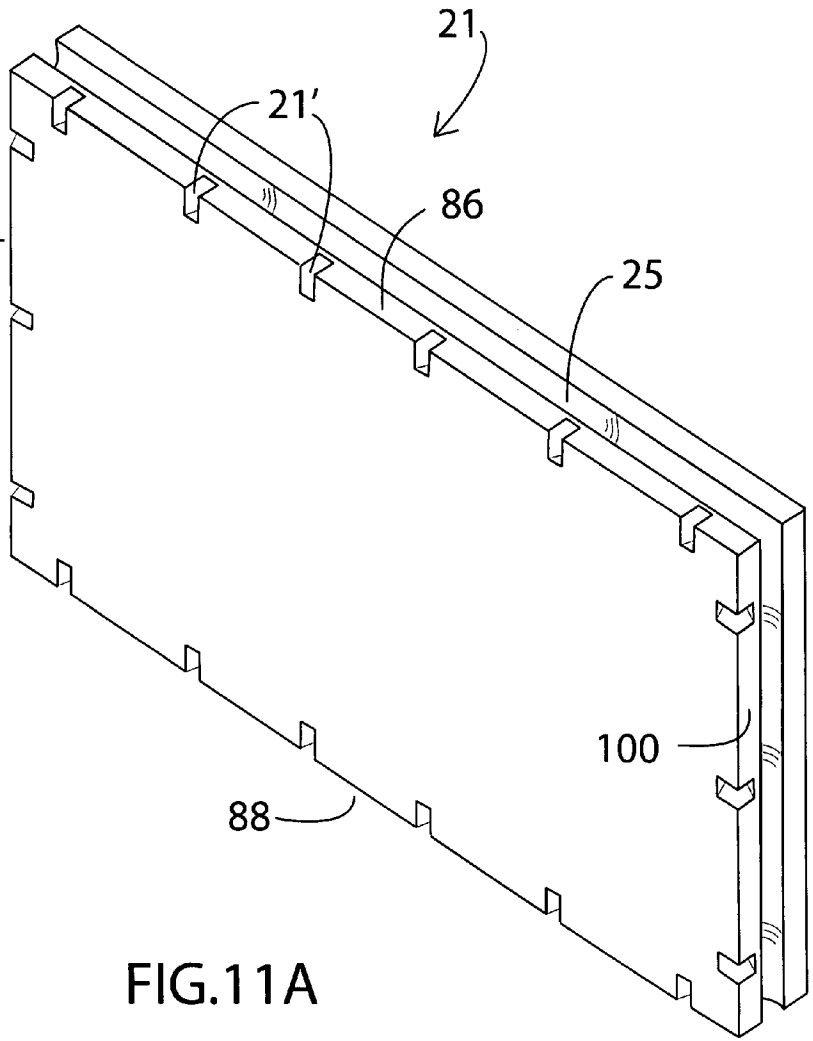
FIG. 11A is a perspective view of the notched block.

FIG. 11A shows a notched block 21 comprising a slot 25 dug in the middle of the periphery of the block. Notches 21' are shown all around the interior face of the block, more precisely the notches are dug on the top 86, below 88, right hand end 100 and left hand end 110 surfaces of the block. Tie means will be inserted inside said notches to join two adjacent surfaces of two blocks. The external face is not intended to be joined with another parallel block.

Figure 11B:
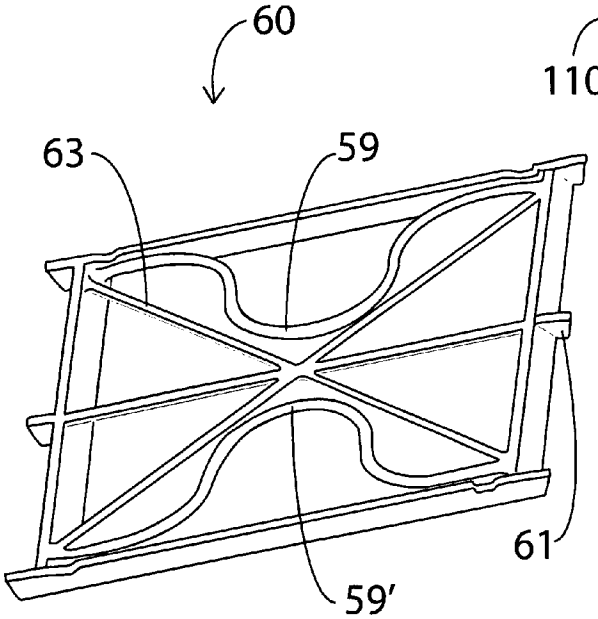
FIG. 11B is a perspective view of a crossed tie with rectangular tip.

FIG. 11B shows the crossed tie 60 comprising a cross part 63 and means of lifting 59,59' to lift the block when the crossed tie is assembled to the block. The pegs are shown rectangular 61.

Figure 11C:
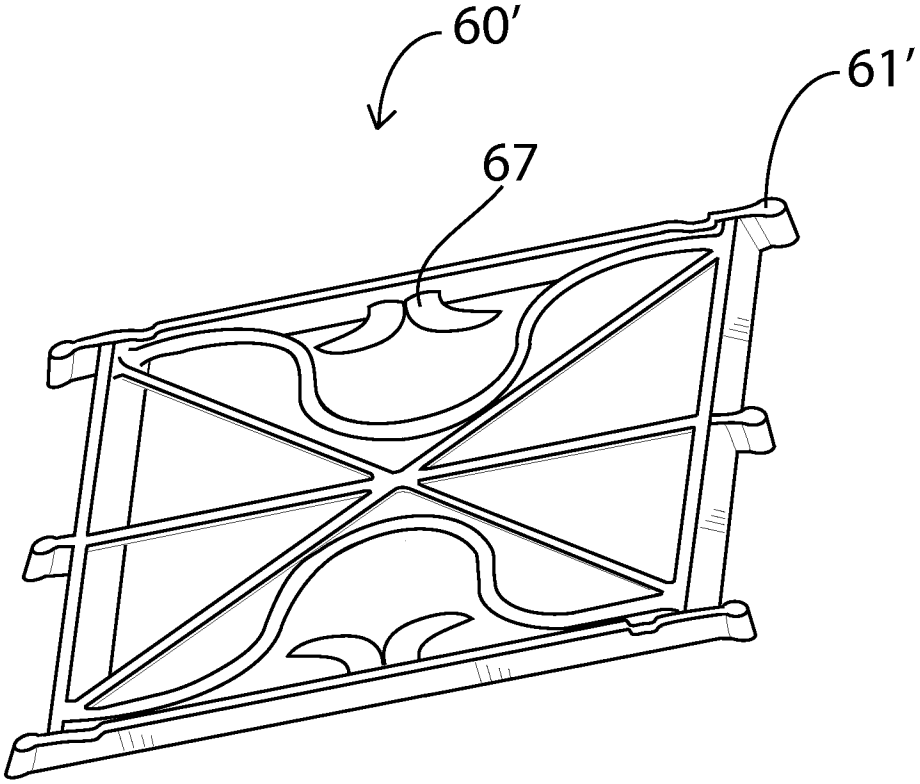
FIG. 11C is a perspective view of a crossed tie with circular or round tip.

FIG. 11C shows a crossed tie 60' with round pegs 61' and retainer hooks 67 for mounting a rubber ring thereto.

SUMMARY OF THE INVENTION

An assembly 20 of at least two independent parts of blocks made of light weight, concrete or rock, parallel, angular, radius, T-shape, shaft-shape; namely a front part 24, a back part 22, both are in a shape of a parallelepiped, and a center part 26 if a three parts block. Between the parts, a void channel 28 or filled channel 30 with an insulating substance, like mineral wool. The channels provide a sound barrier and insulation. Each said parallelepiped have top surfaces 86,86', 86", below surfaces 88,88',88", right hand end surfaces 100, 100',100", and left hand end surfaces 110,110',110", and said top, below, and end surfaces comprise tie means destined to cover two adjacent surfaces, thus maintaining the parallelepiped directly facing each other. Different means of attachment can be used to maintain firmly two blocks together. Such means are: angular pins 34-34", a reversed U pin 32, fiber blankets 49-50, adhesive construction glue, or means of crossed tie resisting shear forces.

Angular pins 34, 34', 34", are installed in opposite directions of two parallelepiped to fix them together in the construction of a block.

An alternative disposition would be to use a reversed U pin 32 set perpendicularly between the parallel parts to maintain them parallel. The pins are ties angularly positioned from 5° to 175° degrees. The back part 22 is provided with an end groove 42 to receive metal strips 58 crossing from parallel part ends to strengthen the blocks. There is a central passage 48 for mortar surrounding a metal rod between an upper and a lower block. The upper face of the center part is pierced in the middle with an enlarged radius cup 46 to position the metal rods. The metal strips are used in assembling blocks in a wall.

Spaced parallel one to the other and having a filled channel 30 in between, the two parallelepiped are related by tie means orientated to maintain the parallelepiped directly facing each other.

Construction tie means may comprise a fibreglass blanket 49 comprising a knitting in three directions namely towards a left side, towards a right side and towards a transverse direction.

A third parallelepiped defines a central part 26 located between a front part 24 and a back part 22 all three separated by two filled channels (or void channels).

Tie means may comprise two half blankets 50 each comprising a left orientated fibreglass tape 69, a right orientated fibreglass tape 70, an end fibreglass tape 71 and a transverse fibreglass tape 72.

Tie means may comprise two pairs of angular pins 34 disposed to maintain the three parallelepiped at a parallel distance one from the other.

The construction block central part 26 may comprise a central passage 48 for passing a metal rod 54 with an enlarged radius 46 for receiving any second rod, the central part further comprising end grooves 42 passing a second block central part 26'. The central part 26 may be a structural strengthening part. Wire means 76 may comprise means for retaining a front surface from falling apart.

The construction block may also comprise rubber spacers 74 added to the fibreglass blanket in a transverse direction with spacers touching respective walls of the parallelepiped when subjected to a transverse blow. The construction block may have as filled channels 30 hot & cold insulation 78. The construction block can be wrapped in a fiberglass blanket held in place by an adhesive disposed over an external face of the parallelepiped and over a face matching a filled channel. A parallelepiped may comprise a grooved channel for holding tension wire means comprising a nylon wire, a steel wire to cover the blanket and keep it in place within the groove channel. An epoxy spread may be used above or below the blanket.

Another means of attachment are crossed ties 60 in a shape of a rectangle wherein opposite corners are joined by straight webs 63 for avoiding shifting when the blocks are subjected to oscillating during wind, storm, landslides or earthquake. Pegs 61,61' are provided to mesh with critical positions in the blocks for stable junctions. The tips are be in a rectangular 61 or a round 61' shape.

With such attachments, the blocks are made with notches 21' dug on top, below, right hand end and left hand end surfaces of the blocks. The crossed tie are then pressed inside the notches 21' of the block. The crossed ties are provided with means of lifting 59 to lift the assemblage of blocks with crossed ties.

Many external features could be provided with the blocks, namely: colored, rock, marble and architectural design. Two blocks joined with a means of attachment could be of different material, such as a marble block joint with a rock block. Or a cement block joint with a wood block. The crossed ties 60 can comprise a retainer hook 67 destined to hook on rubber rings to keep parallel back and front blocks together when erecting sound barrier walls.

The insulation may be a high density rigid board which uses adhesive on both sides and is glued against each part 22, 24, 26. The insulation may also be wrapped in a plastic film 84 which holds the insulating matter in a rigid state. The plastic film is also glued against the parts.

The construction block parallelepiped may be of cementitious material. Parallel blocks may be angled, curved, or crosslike.

It is to be clearly understood that the instant description with reference to the annexed drawings is made in an indicative manner and that the preferred embodiments described herein are meant in no way to limit further embodiments realizable within the scope of the invention.

| LEGEND | |
|---|---|
| 20 | Assembly |
| 21 | Notched block |
| 21' | Notches |
| 22 | Back parallelpiped part |
| 24 | Front parallelpiped part |
| 25 | Slot |
| 26 | Central part |
| 28 | Void channel |
| 30 | Filled channel |
| 32 | Reverse U pin |
| 34, 34', 34" | Angular pins |
| 35 | Penetration hole |
| 36 | Key slot |
| 38 | Legs |
| 40 | length of penetration |
| 42 | End groove |
| 44, 44', 44", 44"' | Groove channels |
| 46 | Enlarged radius |
| 47, 47' | Drilled page |
| 48 | Central passage |
| 49 | Fibreglass blanket |
| 50 | Half blanket |
| 51 | Row of blocks |
| 52 | Mortar |
| 53 | Metal screw |
| 54 | Vertical metal rod |
| 55 | Horizontal rod |
| 56 | Rod distance |
| 57 | Junction |
| 58 | First metal strip |
| 59, 59' | Means of lifting |

-continued

| LEGEND | |
|---|---|
| 60, 60' | Crossed tie |
| 61 | Rectangular pegs |
| 61' | Round pegs |
| 62 | Angular direction |
| 63 | Diagonal member |
| 64 | Strengthening yoke |
| 65 | Center member |
| 66 | Second metal strip |
| 67 | Retainer hook |
| 68 | Utility groove |
| 69 | Left oriented fibreglass tape |
| 70 | Right oriented tape |
| 71 | End fibreglass tape |
| 72 | Transverse fibreglass tape |
| 74 | Rubber spacer |
| 76 | Wire (nylon, metal, epoxy) |
| 78, 78' | Hot & cold insulation |
| 80, 80', 80", 80"' | Adhesive |
| 82 | Sleeve |
| 84 | Plastic film |
| 86, 86', 86" | Top surfaces |
| 88, 88', 88" | Below surfaces |
| 100, 100', 100" | Right hand end surfaces |
| 110, 110', 110" | Left hand end surfaces |

The invention claimed is:

1. A construction block unit comprising:

a first block having an interior surface;

a second block having an interior surface, and being arranged with respect to the first block so that the interior surface of the second block faces the interior surface of the first block; and a channel located between the first block and the second block, said channel covering the entire interior surfaces of the first and second block; and a plurality of ties which connects the first block to the second block, each tie comprising:

a left extension which extends between the first block and the second block;

a right extension which extends between the first block and the second block;

a front extension which connects a front end of the left extension to a front end of the right extension;

a rear extension which connects a rear end of the left extension to a rear end of the right extension;

a first cross extension which connects a front left corner of the tie, located closer to a location at which the front extension connects to the left extension than to both a center of the front extension and a center of the left extension, to a rear right corner of the tie, located closer to a location at which the rear extension connects to the right extension than to both a center of the rear extension and a center of the right extension; and a second cross extension which connects a rear left corner of the tie, located closer to a location at which the rear extension connects to the left extension than to both a center of the rear extension and a center of the left extension, to a front right corner of the tie, located closer to a location at which the front extension connects to the right extension than to both a center of the front extension and a center of the right extension;

wherein each of the first and second blocks further comprise:

a top surface;

a bottom surface;

a left end surface; and a right end surface;

wherein at least one of the ties connects the top surface of the first block to the top surface of the second block;

wherein at least one of the ties connects the bottom surface of the first block to the bottom surface of the second block;

wherein at least one of the ties connects the left end surface of the first block to the left end surface of the second block; and wherein at least one of the ties connects the right end surface of the first block to the right end surface of the second block.

2. The construction block unit of claim 1, further comprising:

rubber spacers positioned within said channel.

3. The construction block unit of claim 1;

wherein each of the ties further comprises a retainer hook.

4. The construction unit block of claim 1;

wherein each of the ties further comprises a means of lifting to lift said ties and the first and second blocks attached thereto.

5. The construction block unit of claim 1;

wherein at least one block of the first and second blocks comprises:

a grooved channel extending between a left end side and a right end side of the at least one block; and a tension wire means arranged in the grooved channel, and comprising:

a nylon wire, a steel wire; and an epoxy spread.

6. The construction block unit of claim 1;

wherein a front surface, located opposite to the interior surface, of the first block comprises at least one external feature selected from the group consisting of colored material, rock, marble, and architectural design.

7. The construction block unit of claim 1, further comprising:

a metal rod;

wherein at least one of the first and second blocks further comprises a passage, passing from the top surface to the bottom surface;

wherein the metal rod is arranged within the passage.

8. The construction block unit of claim 1;

wherein the first and second blocks comprise at least one material selected from the group consisting of cementitious material, stone, rock, marble, granite.

9. The construction block unit of claim 1, further comprising:

a strengthening yoke which connects a top end and a bottom end of a left side of one of the first and second blocks to a center portion of a left side of the other of the first and second blocks.

10. The construction block unit of claim 1;

wherein said channel is filled with a material.

11. The construction block unit of claim 10;

wherein the material filling the channel comprises insulation material.

12. The construction block unit of claim 11;

wherein said insulation material is wrapped in a film.

13. The construction block unit of claim 1, further comprising:

a third block having an interior surface, and being arranged with respect to the second block so that the interior surface of the third block faces a second interior surface of the second block; and a second channel located between the second block and the third block, said channel covering the entire second interior surface of the second block and the entire interior surface of the third block.

14. The construction block unit of claim 13;

wherein each of the channel and the second channel is filled with a material.

15. A construction block wall comprising:

a plurality of said construction block units according to claim 1;

a vertical rod located between two of the construction block units which are arranged horizontally next to each other; and a strengthening horizontal rod which is connected to the vertical rod.

* * * * *